US006676844B2

(12) United States Patent
Lee et al.

(10) Patent No.: US 6,676,844 B2
(45) **Date of Patent: *Jan. 13, 2004**

(54) METHOD FOR MANUFACTURING INK-JET PRINTHEAD HAVING HEMISPHERICAL INK CHAMBER

(75) Inventors: Sang-wook Lee, Seongnam (KR); Hyeon-cheol Kim, Seoul (KR); Yong-soo Oh, Seongnam (KR)

(73) Assignee: Samsung Electronics Co. Ltd., Kyungki-do (KR)

( * ) Notice: Subject to any disclaimer, the term of this patent is extended or adjusted under 35 U.S.C. 154(b) by 37 days.

This patent is subject to a terminal disclaimer.

(21) Appl. No.: 10/020,122

(22) Filed: Dec. 18, 2001

(65) Prior Publication Data

US 2002/0096489 A1 Jul. 25, 2002

(30) Foreign Application Priority Data

Dec. 18, 2000 (KR) ..... 2000-77744

(51) Int. Cl.[7] ..... B41J 2/16

(52) U.S. Cl. ..... 216/27; 216/39; 216/46; 216/79; 216/99

(58) Field of Search ..... 216/27, 46, 39, 216/79, 99; 29/890.1; 438/21; 347/65

(56) References Cited

U.S. PATENT DOCUMENTS

| | | | | |
|---|---|---|---|---|
| 4,339,762 A | | 7/1982 | Shirato et al. | 346/140 R |
| 4,847,630 A | | 7/1989 | Bhaskar et al. | 346/1.1 |
| 4,882,595 A | | 11/1989 | Trueba et al. | 346/140 R |
| 5,385,635 A | * | 1/1995 | O'Neill | 216/27 |
| 5,760,804 A | | 6/1998 | Heinzl et al. | 347/56 |
| 5,825,385 A | * | 10/1998 | Silverbrook | 347/56 |
| 5,841,452 A | | 11/1998 | Silverbrook | 347/47 |
| 5,850,241 A | | 12/1998 | Silverbrook | 347/54 |

(List continued on next page.)

FOREIGN PATENT DOCUMENTS

| | | | | |
|---|---|---|---|---|
| EP | 317171 | | 5/1989 | |
| JP | 63197652 A | * | 8/1988 | B41J/3/04 |
| JP | 04241955 A | * | 8/1992 | B41J/2/16 |

OTHER PUBLICATIONS

Tseng et al.—A Novel Microinjector with Virtual Chamber Neck, IEEE 1998, pp. 57–62, Micro Electro Mechanical Systems, 1998, MEMS 98. Proceedings., The 11$^{th}$ Annual Intl. Workshop on, Jan. 25–29, 1998.

*Primary Examiner*—Anita Alanko
(74) *Attorney, Agent, or Firm*—Lee & Sterba, P.C.

(57) ABSTRACT

A method for manufacturing an ink-jet printhead having a hemispherical ink chamber, wherein a nozzle plate is formed on a surface of substrate; a heater is formed on the nozzle plate; a manifold for supplying ink; an electrode is formed on the nozzle plate to be electrically connected to the heater; a nozzle is formed by etching the nozzle plate inside the heater; a groove for forming an ink channel is formed to expose the substrate so that the groove extends from the outside of the heater toward the manifold; an ink chamber is formed to have a diameter greater than the diameter of the heater and be hemispherical by etching the substrate exposed by the nozzle; an ink channel is formed to be in flow communication with the ink chamber and the manifold; and the groove is closed by forming a material layer on the nozzle plate.

12 Claims, 14 Drawing Sheets

U.S. PATENT DOCUMENTS 6,022,482 A * 2/2000 Chen et al. ..... 216/27
6,093,330 A 7/2000 Chong et al. ..... 216/2
6,402,972 B1 * 6/2002 Weber et al. ..... 216/27
6,478,408 B2 * 11/2002 Lee et al. ..... 347/56
6,499,832 B2 * 12/2002 Lee et al. ..... 347/56
6,533,399 B2 * 3/2003 Lee et al. ..... 347/61
6,561,626 B1 * 5/2003 Min et al. ..... 347/47
6,585,355 B2 * 7/2003 Lee et al. ..... 347/56
2002/0075360 A1 * 6/2002 Maeng et al. ..... 347/65
2003/0035029 A1 * 2/2003 Lee et al. ..... 347/56
2003/0038862 A1 * 2/2003 Lee et al. ..... 347/61
2003/0081069 A1 * 5/2003 Kim et al. ..... 347/56
2003/0109073 A1 * 6/2003 Park et al. ..... 438/21
2003/0142169 A1 * 7/2003 Maeng et al. ..... 347/47

* cited by examiner

METHOD FOR MANUFACTURING INK-JET PRINTHEAD HAVING HEMISPHERICAL INK CHAMBER

BACKGROUND OF THE INVENTION

1. Field of the Invention

The present invention relates to a method for manufacturing an ink-jet printhead. More particularly, the present invention relates to a method for manufacturing an ink-jet printhead having a hemispherical ink chamber.

2. Description of the Related Art

Ink-jet printheads are devices for printing a predetermined image by ejecting small droplets of printing ink at desired positions on a recording sheet. Ink ejection mechanisms of an ink-jet printer are generally categorized into two different types: an electro-thermal transducer type (bubble-jet type), in which a heat source is employed to form a bubble in ink causing an ink droplet to be ejected, and an electromechanical transducer type, in which a piezoelectric crystal bends to change the volume of ink causing an ink droplet to be expelled.

FIGS. 1A and 1B are diagrams illustrating a conventional bubble-jet type ink-jet printhead. Specifically, FIG. 1A is a perspective view illustrating the structure of an ink ejector as disclosed in U.S. Pat. No. 4,882,595. FIG. 1B illustrates a cross-sectional view of the ejection of an ink droplet in the conventional ink ejector.

The conventional bubble-jet type ink-jet printhead shown in FIGS. 1A and 1B includes a substrate 10, a barrier wall 12 formed on the substrate 10 to form an ink chamber 13 for containing ink 19, a heater 14 installed in the ink chamber 13, and a nozzle plate 11 having a nozzle 16 for ejecting an ink droplet 19'. The ink 19 is supplied to the ink chamber 13 through an ink channel 15, and the ink 19 fills the nozzle 16 connected to the ink chamber 13 by capillary action. In a printhead of the current configuration, if current is applied to the heater 14 to generate heat, a bubble 18 is generated in the ink 19 filling the ink chamber 13 and continues to expand. Due to the expansion of the bubble 18, pressure is applied to the ink 19 within the ink chamber 13, and thus the ink droplet 19' is ejected through the nozzle 16. Next, ink 19 is supplied through the ink channel 15 to refill the ink chamber 13.

There are multiple factors and parameters to consider in making an ink-jet printhead having a bubble-jet type ink ejector. First, it should be simple to manufacture, have a low manufacturing cost, and be capable of being mass-produced. Second, in order to produce high quality color images, the formation of minute, undesirable satellite ink droplets that usually trail an ejected main ink droplet must be avoided. Third, when ink is ejected from one nozzle or when ink refills an ink chamber after ink ejection, cross-talk with adjacent nozzles, from which no ink is ejected, must be avoided. To this end, a back flow of ink in a direction opposite to the direction ink is ejected from a nozzle must be prevented during ink ejection. Fourth, for high speed printing, a cycle beginning with ink ejection and ending with ink refill in the ink channel must be carried out in as short a period of time as possible. In other words, an ink-jet printhead must have a high driving frequency.

The above requirements, however, tend to conflict with one another. Furthermore, the performance of an ink-jet printhead is closely associated with and affected by the structure and design of an ink chamber, an ink channel, and a heater, as well as by the type of formation and expansion of bubbles, and the relative size of each component.

In an effort to overcome problems related to the above requirements, various ink-jet printheads having different structures have already been suggested in U.S. Pat. No. 4,882,595; U.S. Pat. No. 4,339,762; U.S. Pat. No. 5,760,804; U.S. Pat. No. 4,847,630; U.S. Pat. No. 5,850,241; European Patent No. 317,171; and Fan-gang Tseng, Chang-jin Kim, and Chih-ming Ho, "A Novel Microinjector with Virtual Chamber Neck," IEEE MEMS, pp. 57–62, 1998. However, ink-jet printheads proposed in the above-mentioned patents and publication may satisfy some of the aforementioned requirements but do not completely provide an improved ink-jet printing approach.

SUMMARY OF THE INVENTION

In an effort to solve the above-described problems, it is a feature of an embodiment of the present invention to provide a method for manufacturing an ink-jet printhead having a hemispherical ink chamber and other components integrally formed on a substrate, including an ink channel, a nozzle, and a heater.

Accordingly, an embodiment of the present invention provides a method for manufacturing an ink-jet printhead having a hemispherical ink chamber, the method comprising: forming a nozzle plate on a surface of a substrate; forming a ring-shaped heater on the nozzle plate; forming a manifold for supplying ink by etching the substrate; forming an electrode on the nozzle plate to be electrically connected to the heater; forming a nozzle, through which ink will be ejected, by etching the nozzle plate inside the heater to have a diameter smaller than the diameter of the heater; forming a groove for forming an ink channel to expose the substrate by etching the nozzle plate so that the groove extends from the outside of the heater toward the manifold; forming an ink chamber to have a diameter greater than the diameter of the heater and be substantially hemispherical by etching the substrate exposed by the nozzle; forming an ink channel to connect the ink chamber and the manifold by isotropically etching the substrate exposed by the groove; and closing the groove by forming a first material layer on the nozzle plate.

Here, the first material layer is preferably a silicon nitride layer. Preferably, the thickness of the first material layer is greater than half of the width of the groove.

According to the present invention, an ink chamber, an ink channel, and an ink supply manifold are integrated into one body in a substrate, and a nozzle plate and a heater are integrated into one body on the substrate. Accordingly, the manufacture of an ink-jet printhead having a structure according to the present invention is simplified, and thus mass production of the printhead is facilitated. In addition, since a groove for forming an ink channel may be closed with a first material layer, it is possible to prevent ink from leaking out from the groove.

BRIEF DESCRIPTION OF THE DRAWINGS

The above features and advantages of the present invention will become readily apparent to those of ordinary skill in the art by describing in detail preferred embodiments thereof with reference to the attached drawings in which.

DETAILED DESCRIPTION OF THE INVENTION

Figure 1A:
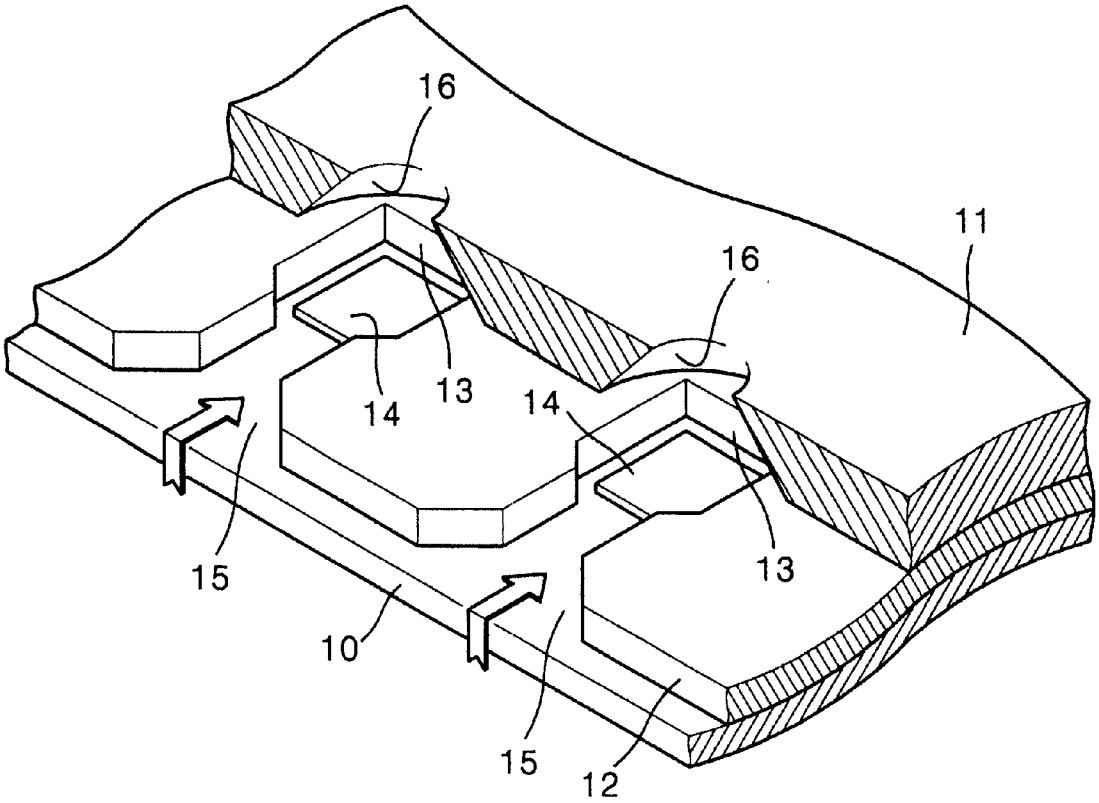
FIG. 1A (PRIOR ART)
FIGS. 1A and 1B illustrate a perspective view and a cross-sectional view, respectively, of a conventional bubble-jet type ink-jet printhead.
Figure 1B:
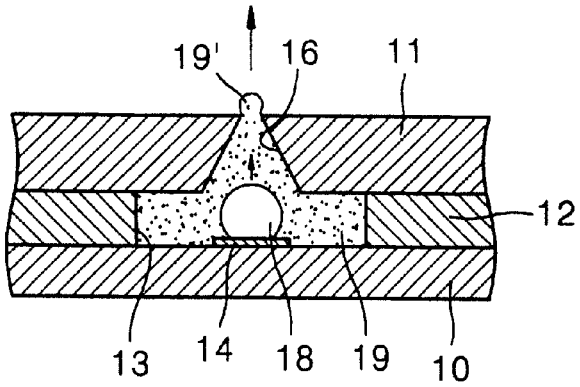
FIG. 1B (PRIOR ART)

Korean Patent Application No. 2000-77744, filed Dec. 18, 2000, entitled: "Method for Manufacturing Ink-Jet Printhead Having Hemispherical Ink Chamber," is incorporated by reference herein in its entirety.

The present invention will now be described more fully with reference to the accompanying drawings, in which preferred embodiments of the invention are shown. This invention may, however, be embodied in many different forms and should not be construed as being limited to the embodiments set forth herein. Rather, these embodiments are provided so that this disclosure will be thorough and complete, and will fully convey the concept of the present invention to those of ordinary skill in the art. In the drawings, the shape and thickness of an element may be exaggerated for clarity, and like reference numerals appearing in different drawings represent like elements. Further, it will be understood that when a layer is referred to as being "on" another layer or substrate, it may be directly on the other layer or substrate, or intervening layers may also be present.

Figure 2:
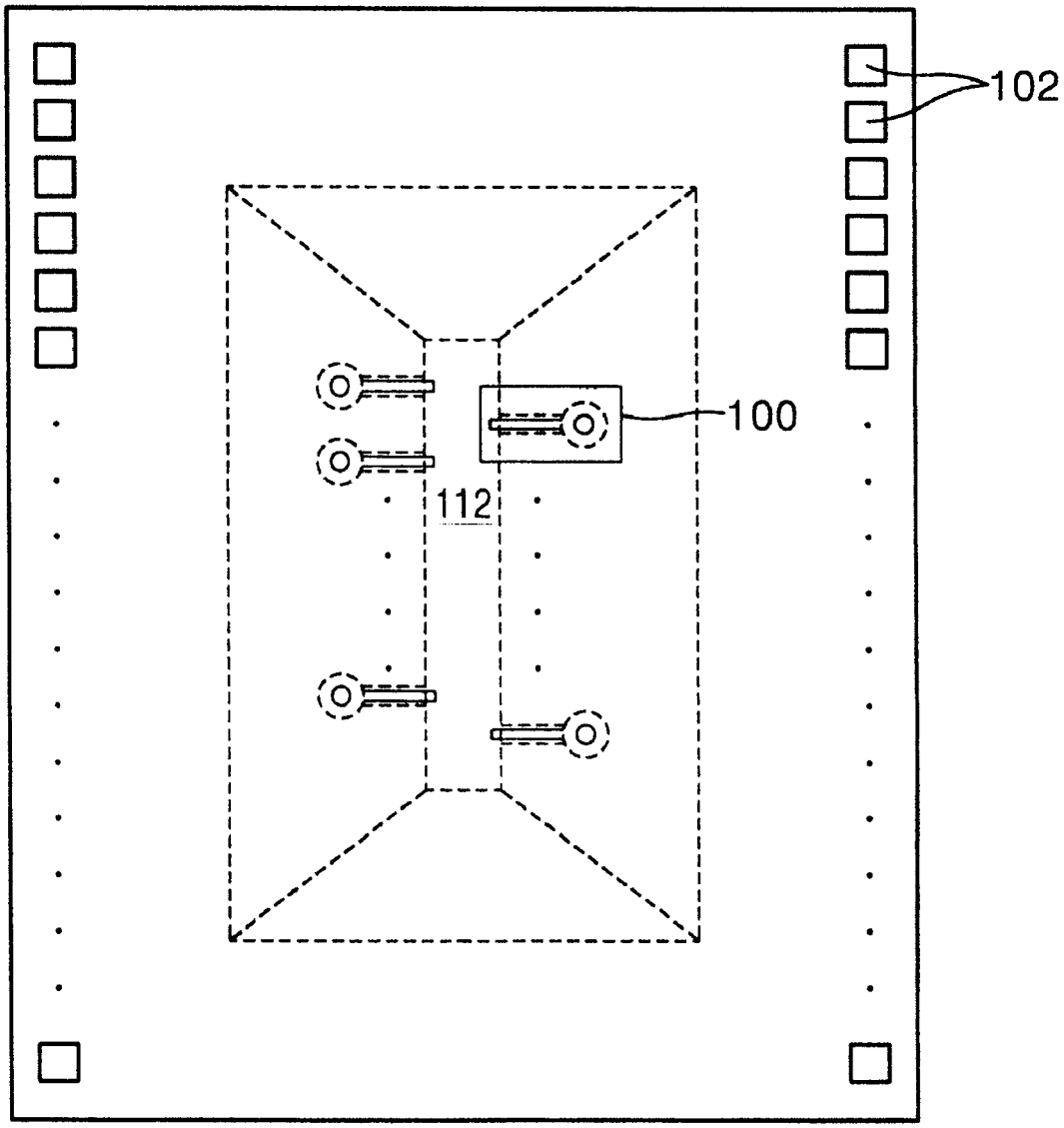
FIG. 2 illustrates a schematic plan view of an ink-jet printhead manufactured by a method for manufacturing an ink-jet printhead according to the present invention.

FIG. 2 is a schematic plan view illustrating an ink-jet printhead manufactured by a method for manufacturing an inkjet printhead according to the present invention. Referring to FIG. 2, ink ejectors 100 are arranged in two rows in an alternating fashion on an ink supplying manifold 112 marked by dotted lines on the ink-jet printhead. Bonding pads 102, to which wires will be bonded, are arranged to be electrically connected to the ink ejectors 100. The manifold 112 is in flow communication with an ink container (not shown), which contains ink. In FIG. 2, the ink ejectors 100 are illustrated as being arranged in two rows, however, they may be arranged in a single row or three or more rows in order to increase resolution. In addition, a printhead using only one color ink is illustrated in FIG. 2; however, three or four groups of ink ejectors may be arranged in order to print color images.

Figure 3:
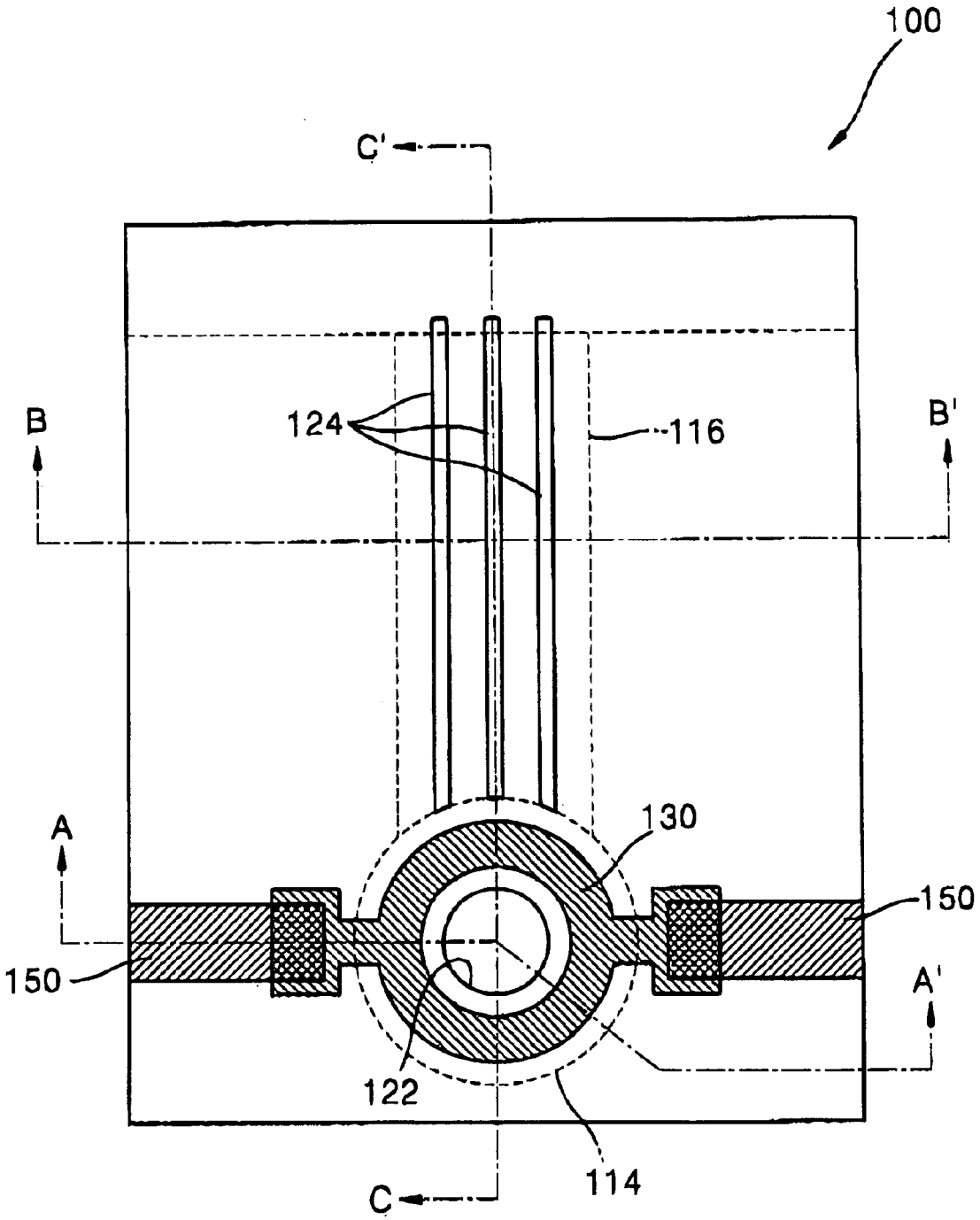
FIG. 3 illustrates an enlarged view of an ink ejector in the ink-jet printhead shown in FIG. 2.

FIG. 3 is an enlarged plan view illustrating an ink ejector shown in FIG. 2, and FIGS. 4A through 4C are cross-sectional views illustrating the vertical structure of the ink ejector, taken along lines A–A', B–B', and C–C', respectively, of FIG. 3.

Referring to FIGS. 3 and 4A through 4C, an ink chamber 114, which will be filled with ink, is formed to be hemispherical on the surface of the substrate 110 of the ink ejector 100, and an ink channel 116, along which ink will be supplied to the ink chamber 114, is formed to be shallower than the ink chamber 114. The manifold 112 is formed on the bottom surface of the substrate 110 to meet one end of the ink channel 116 and to supply ink to the ink channel 116. In addition, a projection 118 for preventing expanded bubbles from bulging into the ink channel 116 is formed at the boundary between the ink chamber 114 and the ink channel 116. Here, the substrate 110 is preferably formed of silicon, which is widely used in the manufacture of integrated circuits.

A nozzle plate 120, through which a nozzle 122 is formed, is formed on the surface of the substrate 110, thereby forming an upper wall of the ink chamber 114. In a case where the substrate 110 is formed of silicon, the nozzle plate 120 may be formed of an insulating layer, such as a silicon oxide layer formed by oxidation of the silicon substrate 100 or a silicon nitride layer deposited on the substrate 110. In addition, a groove 124 for forming the ink channel 116 is formed through the nozzle plate 120 and the groove 124, which will be described in greater detail later, is filled up with a silicon nitride layer or a silicon oxide layer in order to prevent ink from leaking out through the groove 124.

A heater 130 for generating bubbles is formed in a ring shape on the nozzle plate 120 to surround the nozzle 122. The heater 130 is formed of a resistive heating element, such as impurity-doped polysilicon. Electrodes 150, which are typically formed of a metal, are connected to the heater 130 for applying pulse current.

Figure 5:
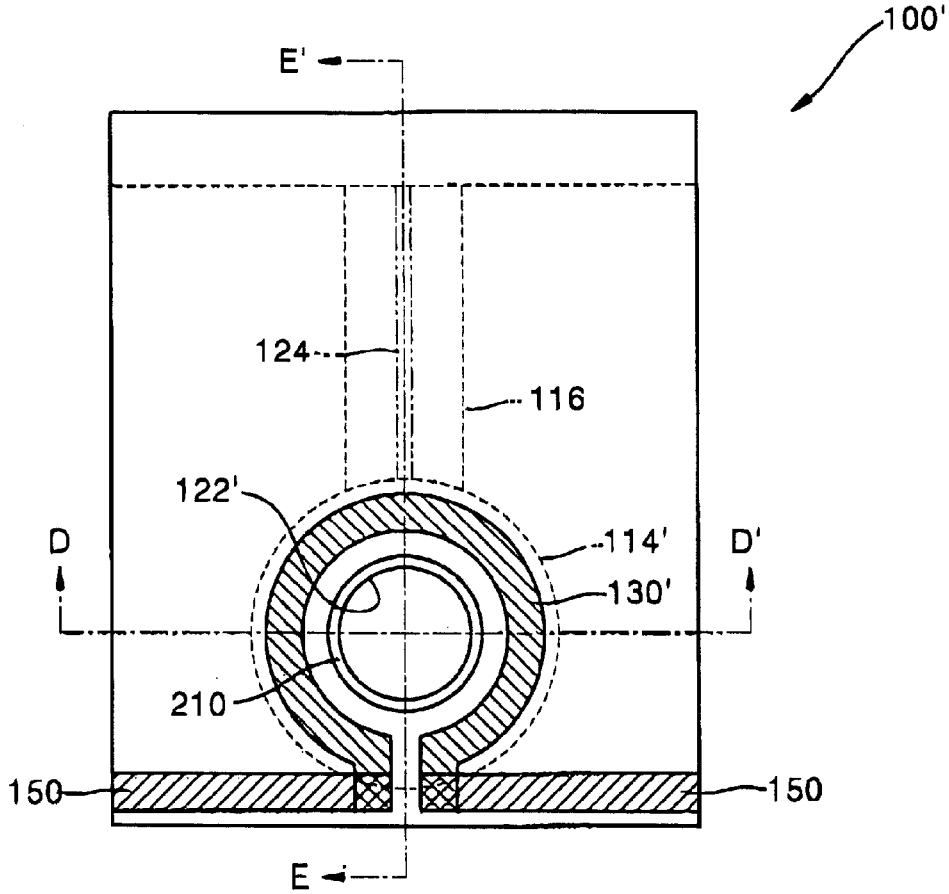
FIG. 5 illustrates a plan view illustrating another example of the ink ejector shown in FIG. 3.
Figure 6A:
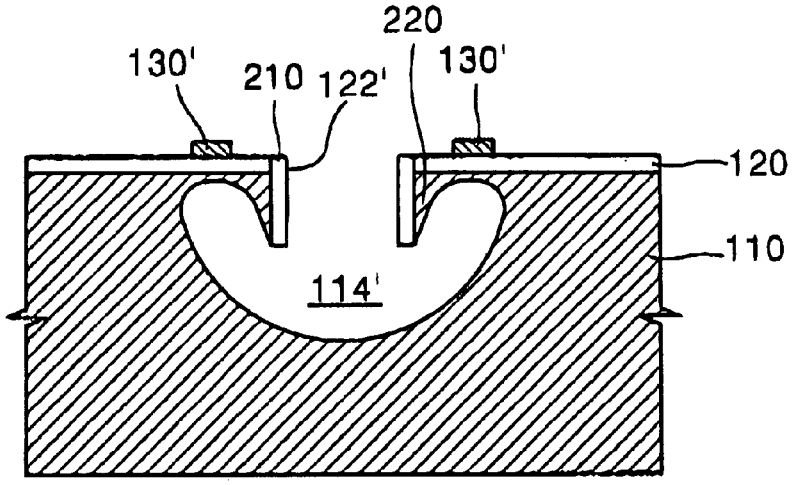
FIGS. 6A and 6B illustrate cross-sectional views illustrating the vertical structure of the ink ejector, taken along lines D–D' and E–E', respectively, of FIG. 5.
Figure 6B:
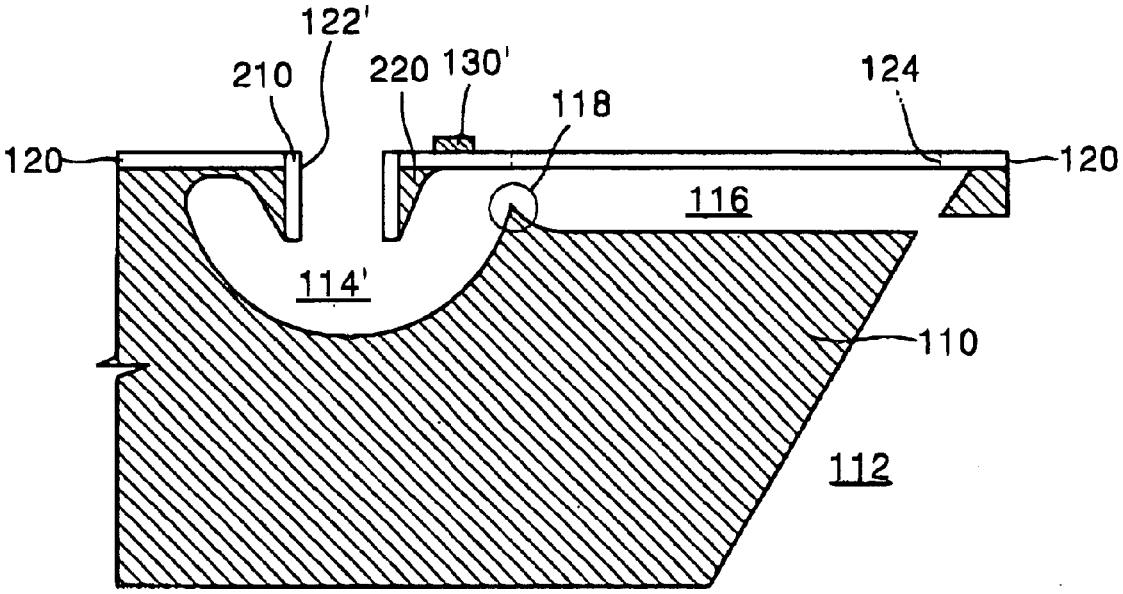

FIG. 5 is a plan view illustrating another ink ejector, and FIGS. 6A and 6B are cross-sectional views illustrating the vertical structure of the ink ejector, taken along lines D–D' and E–E', respectively, of FIG. 5.

Referring to FIGS. 5, 6A, and 6B, a heater 130' of an ink ejector 100' is formed in the shape of the Greek letter omega, and electrodes 150 are connected to the both ends of the heater 130'. In other words, whereas the heater 130 shown in FIG. 3 is connected between the electrodes 150 in parallel, the heater 130' shown in FIG. 5 is connected between the electrodes 150 in series.

Figure 4A:
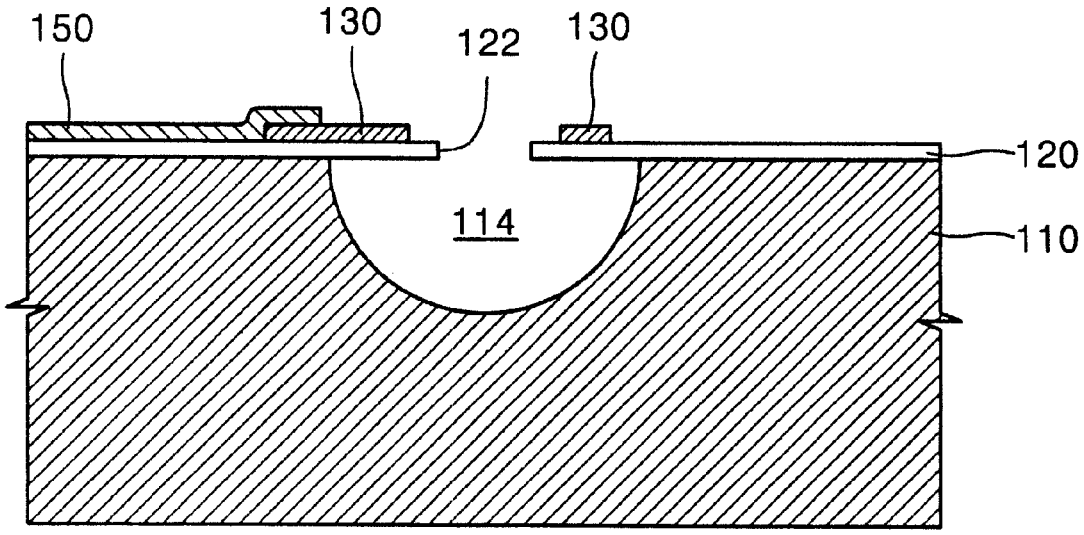
FIGS. 4A through 4C illustrate cross-sectional views showing the vertical structure of the ink ejector, taken along lines A–A', B–B', and C–C', respectively, of FIG. 3.
Figure 4B:
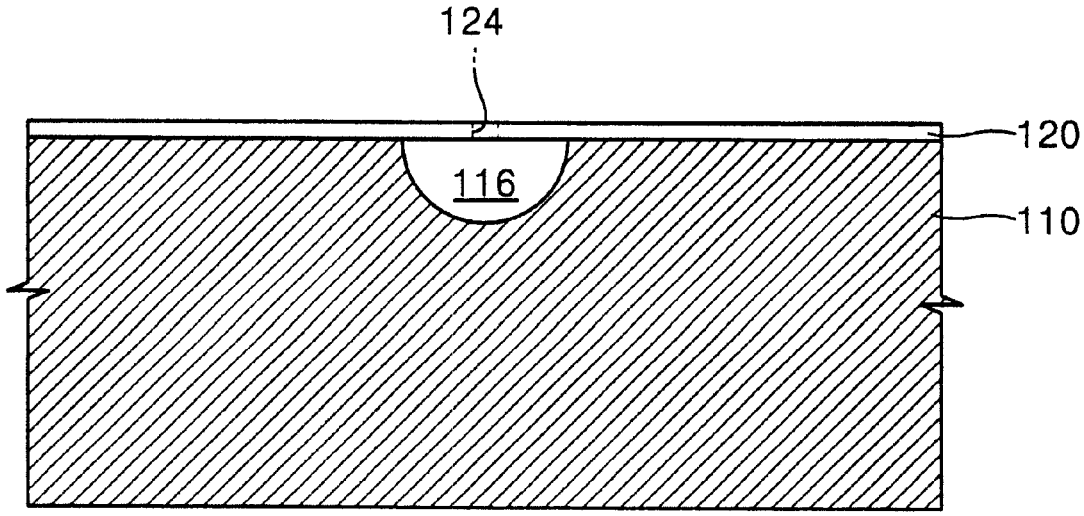
Figure 4C:
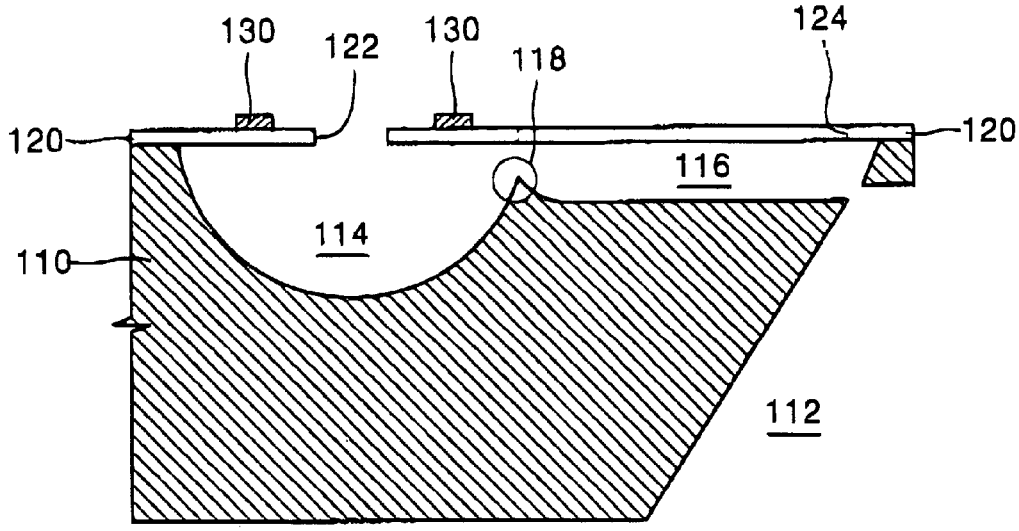

An ink chamber 114', like the ink chamber 114 shown in FIG. 4A, is formed into a hemispherical shape. A droplet guide 210 is formed above the ink chamber 114' to extend from the edge of a nozzle 122' to the inside of the ink chamber 114'. A bubble guide 220 is formed of the material of the substrate 110, which remains around the droplet guide 210, under a nozzle plate 120, which is formed to cover the ink chamber 114'. The functions of the droplet guide 210 and the bubble guide 220 will be described later. The droplet guide 210 and the bubble guide 220 may also be applied to the structure of the ink ejector 100 shown in FIG. 3.

The shape and arrangement of a manifold 112, an ink channel 116, and a projection 118 are the same as the shape and arrangement of the corresponding elements of the ink ejector 100 shown in FIG. 3.

Hereinafter, the ink ejection mechanism of the ink ejector illustrated in FIG. 3 will be described with reference to FIGS. 7A and 7B.

Figure 7A:
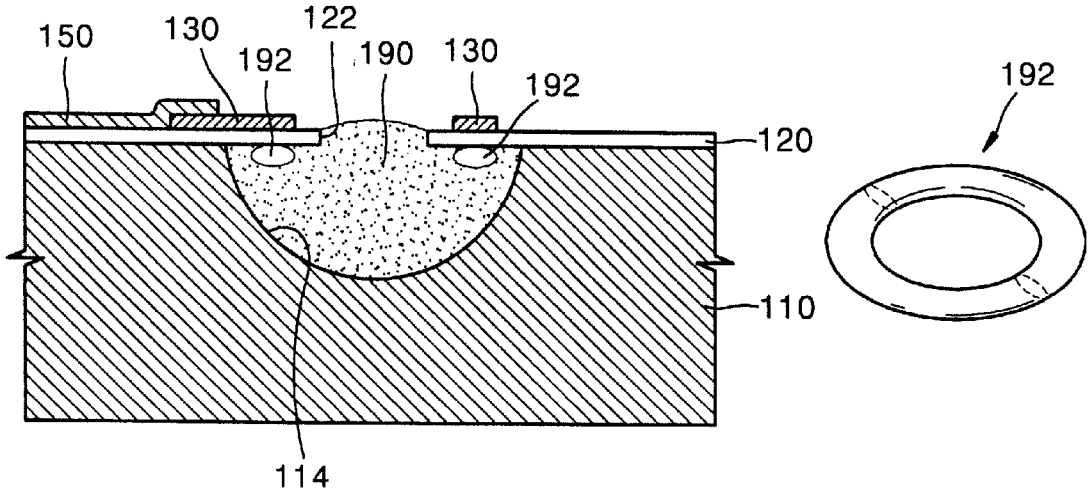
FIGS. 7A and 7B illustrate cross-sectional views of the ink ejection mechanism of the ink ejector shown in FIG. 3.
Figure 7B:
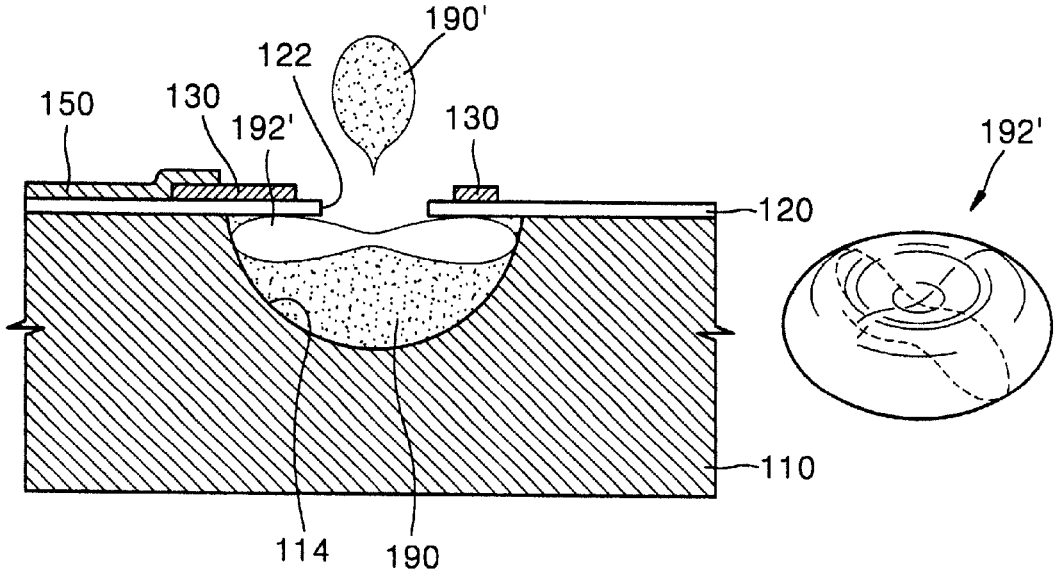

Referring to FIG. 7A, ink 190 is supplied from the manifold (not shown) to the ink chamber 114 via the ink channel (not shown) due to capillary action. If pulse current is applied to the heater 130 by the electrodes 150 in a state where the ink chamber 114 is filled with the ink 190, the heater 130 generates heat. The heat is transmitted to the ink 190 via the nozzle plate 120. Accordingly, the ink begins to boil, and a bubble 192 is generated. The shape of the bubble 192 is formed to be almost the same as a doughnut in accordance with the shape of the heater 130, as illustrated to the right of FIG. 7A.

As time goes by, the doughnut-shaped bubble 192 continues to expand and an empty space inside the bubble 192 shrinks. Finally, the bubble 192 changes into a disk-shaped bubble 192' having a slightly recessed upper center, as illustrated to the right of FIG. 7B. At the same time, an ink droplet 190' is ejected from the ink chamber via the nozzle 122 by the expanding bubble 192'.

If the current applied to the heater 130 is cut-off, the bubble 192' cools. Accordingly, the bubble 192' may begin to contract or burst, and the ink chamber 114 is refilled with ink 190.

According to the ink ejection mechanism of the ink ejector of the printerhead, as described above, if the tail of the ink droplet 190' to be ejected is cut by the doughnut-shaped bubble 192 transforming into the disc-shaped bubble 192', it is possible to prevent the occurrence of small satellite droplets.

In addition, since the heater 130 is formed in a ring shape or an omega shape, it has an enlarged area. Accordingly, the time taken to heat or cool the heater 130 may be reduced, and thus the time period from when the bubbles 192 and 192' first appear to their collapse may be shortened, thereby allowing the heater 130 to have a high response rate and a high driving frequency. In addition, the ink chamber formed into a hemispherical shape has a more stable path for expansion of the bubbles 192 and 192' than a conventional ink chamber formed as a rectangular parallelepiped or a pyramid. Moreover, in the hemispherical ink chamber, bubbles are generated very quickly and quickly expand, and thus it is possible to eject ink within a shorter time.

In addition, since the expansion of the bubbles 192 and 192' is restricted within the ink chamber 114, and accordingly, the ink 190 is prevented from flowing backward, adjacent ink ejectors may be prevented from being affected by one another. Moreover, the ink channel 116 is formed shallower and smaller than the ink chamber 114, and the projection 118 is formed at the boundary between the ink chamber 114 and the ink channel 116. Thus, it is possible to effectively prevent the ink 190 and the bubbles 192 and 192' from bulging into the ink channel 116.

Figure 8A:
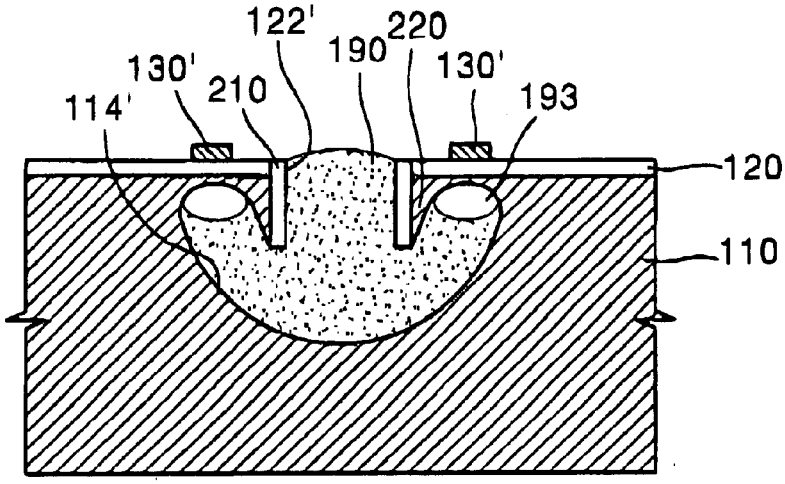
FIGS. 8A and 8B illustrate cross-sectional views of the ink ejection mechanism of the ink ejector shown in FIG. 5.
Figure 8B:
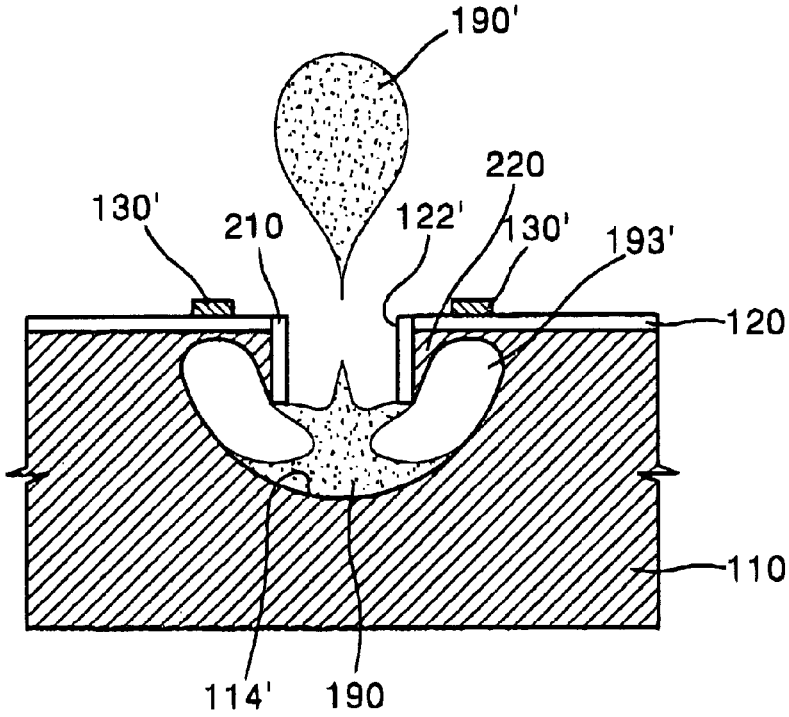

FIGS. 8A and 8B are cross-sectional views illustrating the ink ejection mechanism of the ink ejector shown in FIG. 5.

Only differences between the ink ejection mechanism of the ink ejector shown in FIG. 3 and the ink ejection mechanism of the ink ejector shown in FIG. 5 will be described below. As a bubble 193 generated under the heater 130 expands, the lower portion of the bubble 193 expands downward while the expansion of the upper portion of the bubble 193 is restricted by the bubble guide 220. Accordingly, the hole in the middle of the bubble 193, which is doughnut-shaped, becomes more difficult to be integrated into the bubble 193 directly below the nozzle 122'. However, it is possible to control the probability of the hole in the middle of the doughnut-shaped bubble 193' being integrated into the bubble 193' by controlling the length of the droplet guide 210 and the length of the bubble guide 220 extending down along the droplet guide 210. In the meantime, the direction of ejection of a droplet 190' is guided by the droplet guide 210 extending down toward the bottom of the ink chamber 114' along the edge of the nozzle 122', and thus the droplet 190' may be precisely ejected in a direction perpendicular to the substrate 110.

Hereinafter, a method for manufacturing an ink-jet printhead according to the present invention will be described.

Figure 15:
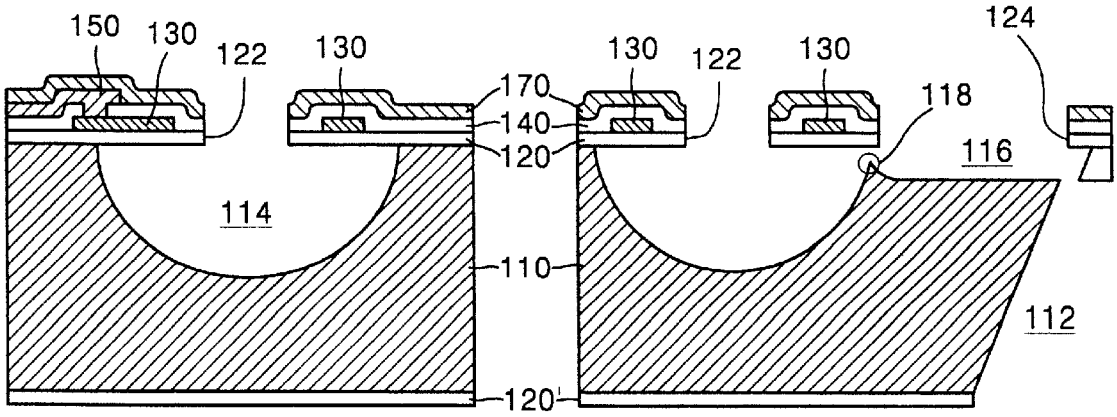
Figure 16:
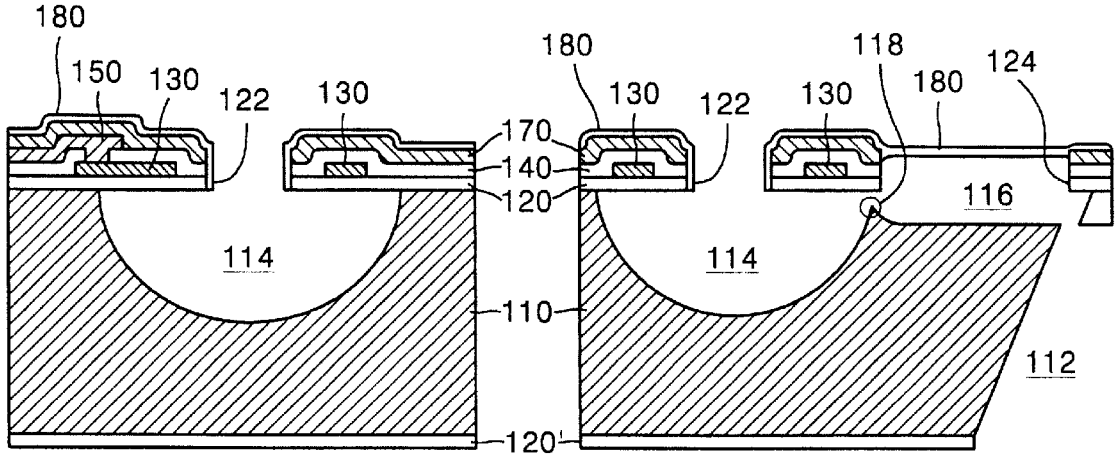
Figure 17:
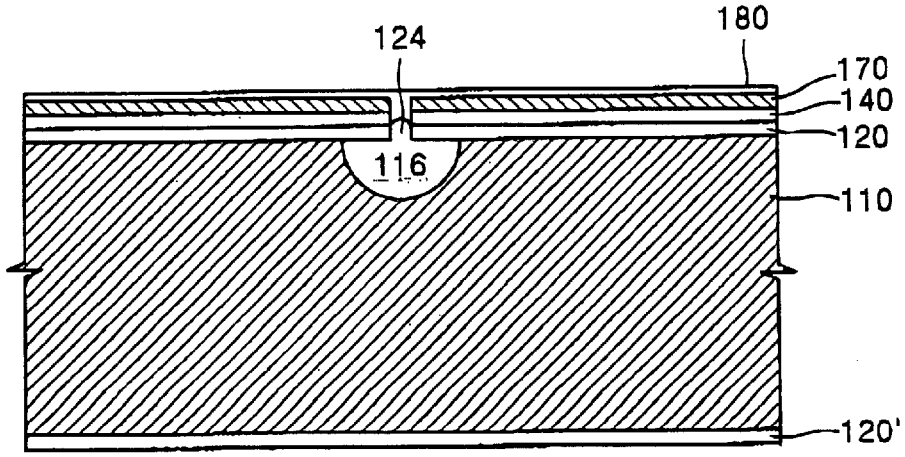

FIGS. 9 through 17 are cross-sectional views illustrating the manufacture of an ink-jet printhead having the ink ejector illustrated in FIG. 3. Specifically, the left side of FIGS. 9 through 16 are cross-sectional views taken along line A–A' of FIG. 3, and the right side of FIGS. 9 through 16 are cross-sectional views taken along line C–C' of FIG. 3. FIG. 17 illustrates a cross-sectional view taken along line B–B' of FIG. 3.

Figure 9:
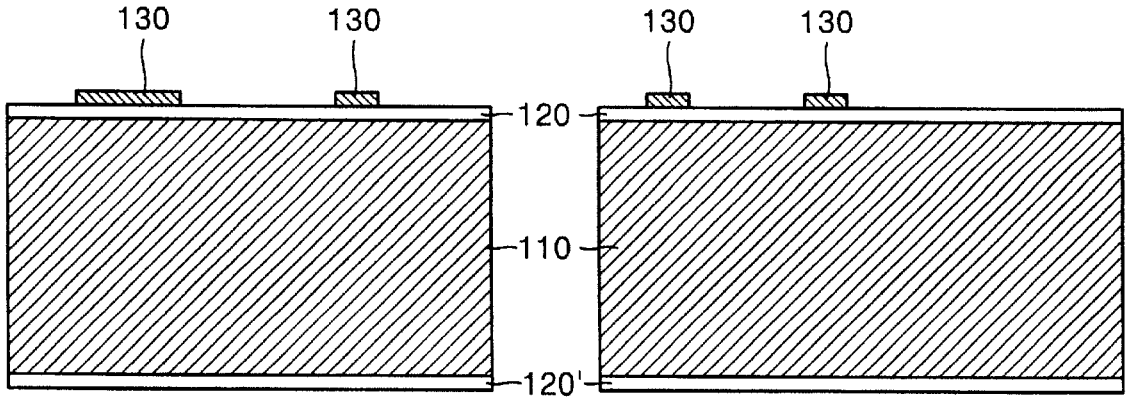
FIGS. 9 through 17 illustrate cross-sectional views showing a method for manufacturing an ink-jet printhead having the ink ejector illustrated in FIG. 3.

Referring to FIG. 9, a silicon wafer having a thickness of about 500 $\mu$m and having a crystal orientation <100> is used as a substrate 110. This selection is because usage of a silicon wafer having been widely used in the manufacture of semiconductor devices contributes to the effective mass production of ink-jet printheads. Next, the substrate 110 is positioned in an oxidation furnace and is wet-oxidized or dry-oxidized. Accordingly, the top and bottom surfaces of the substrate 110 are oxidized, which forms silicon oxide layers 120 and 120' at the top and bottom surfaces of the substrate 110, respectively. The silicon oxide layer 120 formed at the top surface of the substrate 110 will be a nozzle plate, through which a nozzle will be formed.

In FIG. 9, only a portion of a silicon wafer is illustrated. Actually, the printhead according to the present invention is formed to include several tens through several hundreds of chips on a wafer. In addition, the silicon oxide layers 120 and 120' are illustrated as being formed at the top and bottom surfaces, respectively, of the substrate 110 because it is preferred that in the present embodiment, a batch oxidization furnace is used to oxidize the substrate 110. However, in the case of using a sheet-fed oxidization furnace, only the top surface of the substrate 110 may be oxidized, and thus the silicon oxide layer 120' is not formed at the bottom of the substrate 110. Also, other material layers, like the silicon oxide layer 120 or 120', may be formed only at the top surface of the substrate 110 or at both the top and bottom surfaces of the substrate 110 according to types of apparatuses used to form the material layers. However, such material layers (a polysilicon layer, a silicon nitride layer, a tetraethylorthosilicate (TEOS) oxide layer, and so on) will be described and illustrated as being formed only at the top surface of the substrate 110 for the convenience of description.

Next, a heater 130 is formed in a ring shape on the silicon oxide layer 120 on the substrate 110. The heater 130 is formed by depositing impurity-doped polysilicon on the entire surface of the silicon oxide layer 120 and patterning the polysilicon into a ring shape. Specifically, the impurity-doped polysilicon is deposited along with impurities, such as phosphorus source gas, on the silicon oxide layer 120 to a thickness of between about 0.7–1 $\mu$m by low pressure chemical vapor deposition (LPCVD). The thickness of the deposited polysilicon layer may be adjusted to have an appropriate resistance value in consideration of the width and length of the heater 130. The polysilicon layer deposited on the entire surface of the silicon oxide layer 120 is patterned by a photolithographic process using a photomask and photoresist and an etching process using a photoresist pattern as an etching mask.

Figure 10:
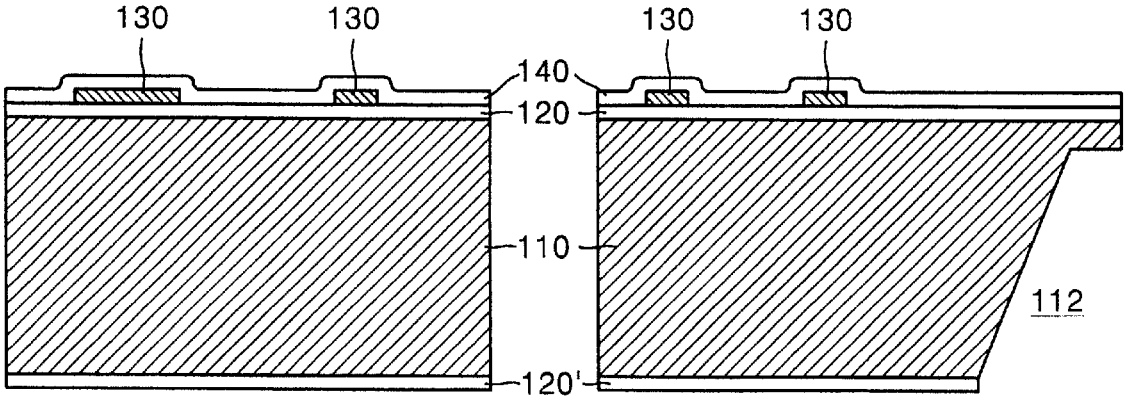

Referring to FIG. 10, a silicon nitride layer 140 is deposited on the surface of the substrate 110, on which the heater 130 has been formed, and a manifold 112 is formed by partially etching the bottom portion of the substrate 110. The silicon nitride layer 140 is a protective layer for the heater 130 and may be deposited to a thickness of about 0.5 $\mu$m by LPCVD. The manifold 112 is formed by etching the bottom portion of the substrate 110 to be slanted. Specifically, an etching mask is formed to define a predetermined portion of the bottom surface of the substrate 110, and the bottom of the substrate 110 is wet-etched using tetramethylammoniumhydroxide (TMAH) as an etchant for a predetermined time. During the wet-etching, since the etching rate of the substrate 110 in a crystal orientation <111> is lower than the etching rate of the substrate 110 in other orientations, the manifold 112 is formed with an inclination angle of about 54.7 degrees.

Alternatively, the manifold 112 may be formed after forming a TEOS layer, (170 of FIG. 11) which will be described later. In addition, the manifold 112 is described above as being formed by inclination etching; however, it may be formed by anisotropic etching. Alternatively, the manifold 112 may be etched to perforate the substrate 110 or may be formed by etching not the bottom of the substrate 110 but rather the top surface of the substrate 110.

Figure 11:
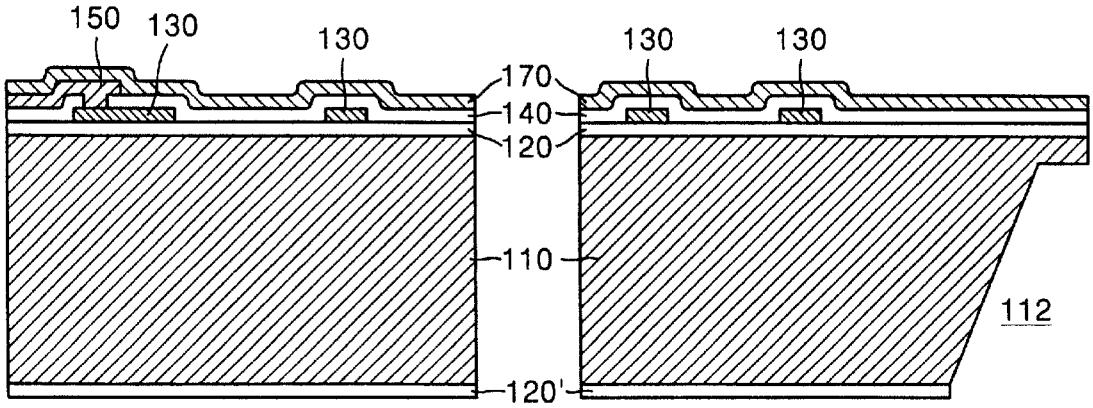

Referring to FIG. 11, an electrode 150 is formed, and then a TEOS oxide layer 170 is formed on the surface of the substrate 110. Specifically, a predetermined portion of the silicon nitride layer 140 on the heater 130 is etched to expose a predetermined portion of the heater 130, which will be connected to the electrode 150. Next, the electrode 150 is formed by depositing a metal which has high conductivity and is easily patterned, such as aluminium or an aluminium alloy, to a thickness of about 1 $\mu$m by sputtering and patterning the metal layer. At the same time, the metal layer is patterned to form wiring lines (not shown) and a bonding pad (102 of FIG. 2) in different regions.

Next, the TEOS oxide layer 170 is deposited on the surface of the substrate 110, on which the electrode 150 has been formed. The TEOS oxide layer 170 may be deposited at a low temperature within a range in which the electrode 150 formed of aluminium or an aluminium alloy and the bonding pad 102 of FIG. 2 are not deformed, for example, at 400° C. or below, by chemical vapor deposition (CVD).

Figure 12:
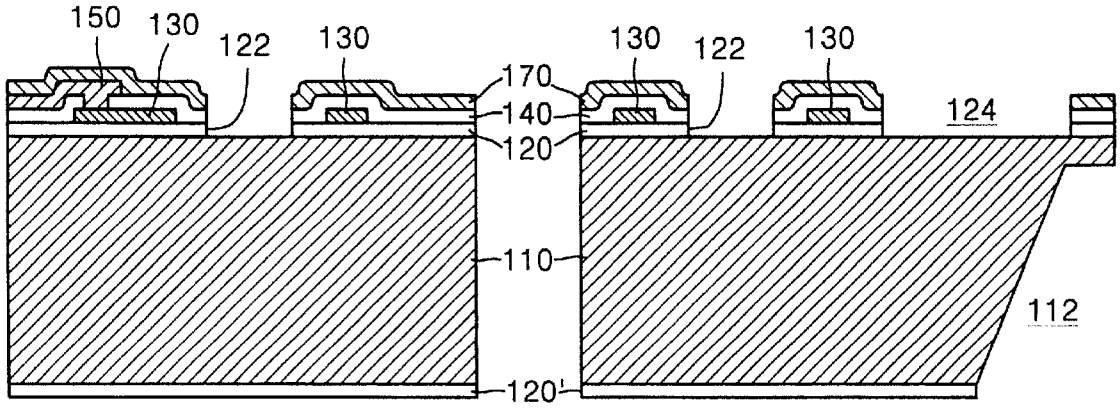

Referring to FIG. 12, a nozzle 122 and a groove 124 for forming an ink channel are formed. Specifically, the TEOS oxide layer 170, the silicon nitride layer 140, and the silicon oxide layer 120 are sequentially etched to form the nozzle 122 having a smaller diameter than the heater 130, such as a diameter of between about 16–20 $\mu$m, inside the heater 130 so that a predetermined portion of the substrate 110 may be exposed. At the same time, as shown in FIG. 12, the groove 124 for forming an ink channel is formed into a line shape outside the heater 130 to extend above the manifold 112. The groove 124 may be formed by sequentially etching the TEOS oxide layer 170, the silicon nitride layer 140, and the silicon oxide layer 120 to expose the substrate 110. The groove 124 is formed to have a length of about 50 $\mu$m and a width of about 2 $\mu$m.

Figure 13:
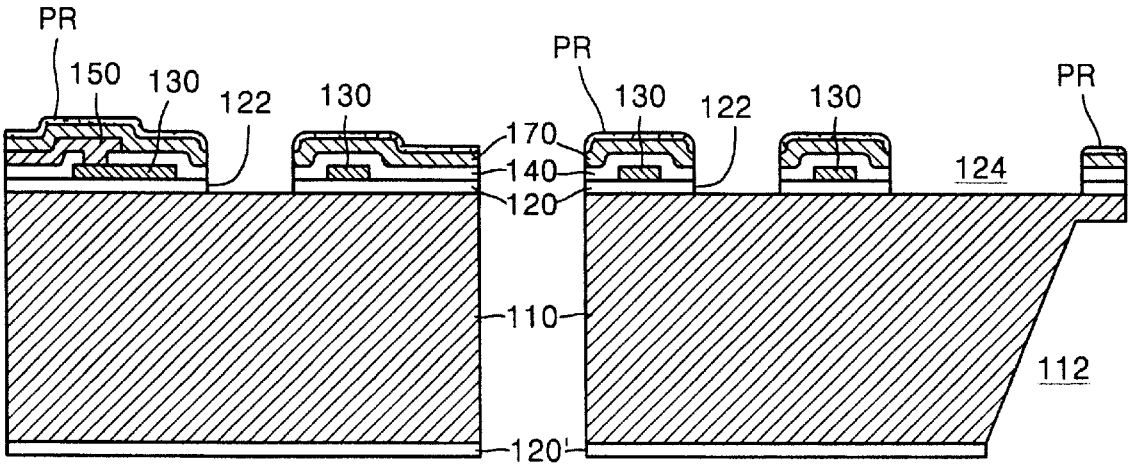

Next, as shown in FIG. 13, photoresist is deposited on the surface of the substrate 110, on which the nozzle 122 and the groove 124 have been formed, and is patterned, thus forming a photoresist pattern PR. The photoresist pattern PR is formed to expose portions of the substrate 110 exposed through the nozzle 122 and the groove 124.

Figure 14:
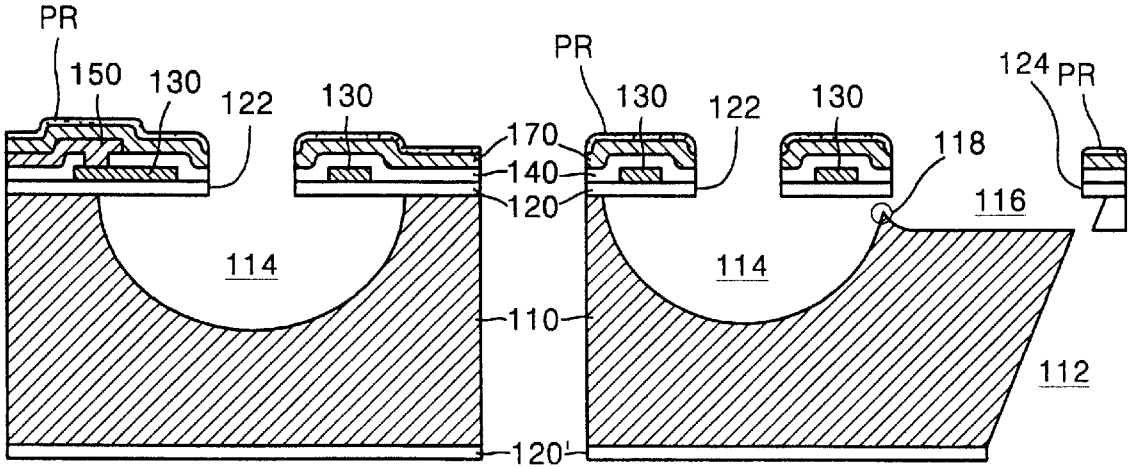

Referring to FIG. 14, the exposed portions of the substrate 110 are etched using the photoresist pattern PR, thereby forming an ink chamber 114 and an ink channel 116. The ink chamber 114 may be formed by isotropically etching the substrate 110 using the photoresist pattern PR as an etching mask. Specifically, the substrate 110 is dry-etched for a predetermined time using $XeF_2$ gas or $BrF_3$ gas as an etching gas. As a result of the dry etching, the ink chamber 114 is formed to have a substantially hemispherical shape with a depth and a diameter of about 20 $\mu$m, and simultaneously, the ink channel is formed to connect the ink chamber 114 and the manifold 112 and have a depth and a diameter of about 8 $\mu$m. In addition, a projection 118 for preventing bubbles generated in the ink chamber 114 from bulging into the ink channel 116 is formed along the boundary between the ink chamber 114 and the ink channel 116. The ink chamber 114 and the ink channel 116 may be formed at the same time or may be sequentially formed.

The ink chamber 114 may be formed by anisotropically etching the substrate 110 using the photoresist pattern PR as an etching mask and then isotropically etching the substrate 110 using the photoresist pattern PR as an etching mask. In other words, the substrate 110 is anisotropically etched using the photoresist pattern PR as an etching mask by inductively coupled plasma etching or reactive ion etching, thereby forming a hole (not shown) having a predetermined depth. Next, the hole in the substrate 110 is isotropically etched by the same method.

Alternatively, the ink chamber 114 may be formed by converting predetermined portions of the substrate 110 corresponding to the space to be occupied by the ink chamber 114 into a porous silicon layer and selectively etching the porous silicon layer.

Referring to FIG. 15, the photoresist pattern PR is removed by an ashing and stripping process. Since the ink channel 116 is exposed through the groove 124, ink may leak out through the groove 124. If ink leaks out through the groove 124, it stains the nozzle 122 and adjacent regions, thus lowering the quality of a printed picture image. Therefore, as shown in FIGS. 16 and 17, the groove 124 is closed with a first material layer.

FIGS. 16 and 17 are cross-sectional views illustrating an ink ejector, on which a silicon nitride layer 180 is deposited to close the groove 124, taken along lines C–C' and B–B', respectively, of FIG. 3. The silicon nitride layer 180 is deposited to a thickness of about 1 $\mu$m by chemical vapor deposition. In other words, the silicon nitride layer 180 is formed to a predetermined thickness sufficient to close the groove 124. For example, the thickness of the silicon nitride layer 180 is no less than half of the width of the groove 124. Accordingly, in a case where the width of the groove 124 is about 2 $\mu$m, the thickness of the silicon nitride layer 180 is preferably no less than 1 $\mu$m. When the silicon nitride layer 180 is deposited to a thickness of about 1 $\mu$m, the diameter of the nozzle 122 is reduced by about 2 $\mu$m. Thus, the nozzle 122 must be formed to have an initial diameter greater than a desired final diameter by about 2 $\mu$m in consideration of the decrease in the diameter in the step of forming the silicon nitride layer 180. The silicon nitride layer 180 may be replaced by a silicon oxide layer and may be formed only around the groove 124 used to form the ink channel 116. If the groove 124 is closed with the silicon nitride layer 180, it is possible to prevent ink from leaking out through the groove 124 and thus prevent deterioration of the quality of a picture image to be printed.

Figure 18:
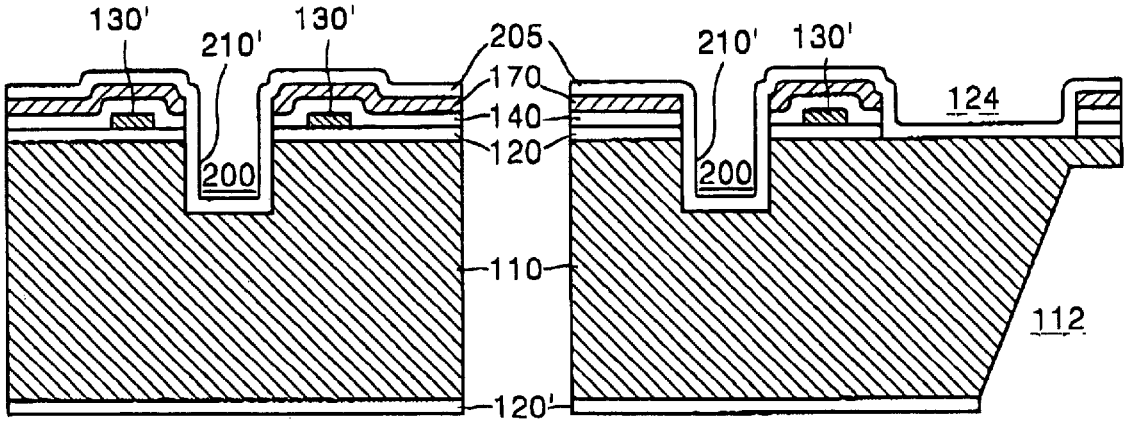
FIGS. 18 through 20 illustrate cross-sectional views showing a method for manufacturing an inkjet printhead having the ink ejector illustrated in FIG. 5.
Figure 19:
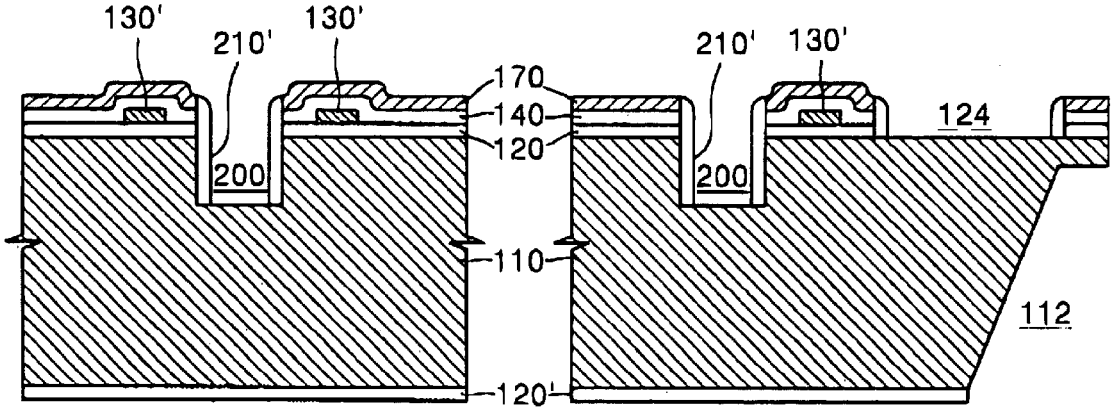
Figure 20:
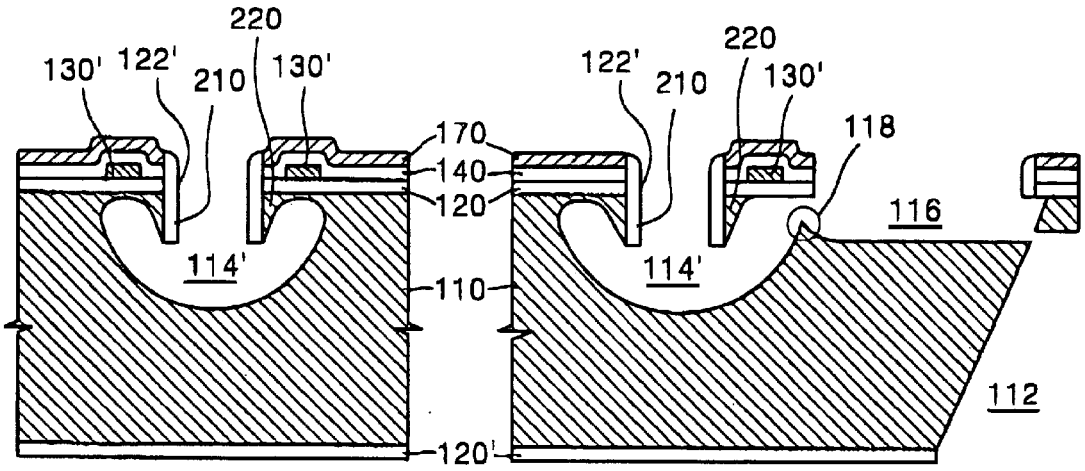

FIGS. 18 through 20 are cross-sectional views illustrating a method for manufacturing a printhead having the ink ejector illustrated in FIG. 5, taken along lines D–D' and E–E', respectively, of FIG. 5.

The method for manufacturing a printhead having the ink ejector shown in FIG. 5 is the same as the method for manufacturing a printhead having the ink ejector illustrated in FIG. 3, except in the formation of a bubble guide. In other words, the method for manufacturing a printhead having the ink ejector shown in FIG. 5 also includes the steps described with reference to FIGS. 9 through 13, like the method for manufacturing a printhead having the ink ejector shown in FIG. 3, but further includes forming a droplet guide and forming a bubble guide. Therefore, only the differences between the two methods will be described in the following.

Referring to FIG. 18, a predetermined portion of the substrate 110, which is illustrated as being exposed by the nozzle 122 in FIG. 13, is anisotropically etched to form a hole 200 having a predetermined depth. Next, the photoresist pattern PR is removed, and a second material layer, such as a TEOS oxide layer 205, is deposited to a thickness of about 1 $\mu$m on the substrate 110. Next, the TEOS oxide layer 205 is anisotropically etched to expose the substrate 110, and thus a spacer 210' is formed at the sidewall of the hole 200, as shown in FIG. 19.

Next, referring to FIG. 20, the exposed portion of the substrate 110 is isotropically etched, and thus an ink chamber 114' and an ink channel 116 are formed. At the same time, a droplet guide 210 is formed around a nozzle 122' to extend down toward the bottom of the ink chamber 114', and a bubble guide 220 is also formed.

Next, the groove 124 is closed by forming a silicon nitride layer on the entire surface of the ink ejector. The step of closing the groove 124 is the same as that of the previous embodiment described with reference to FIGS. 16 and 17.

As described above, the method for manufacturing a bubble-jet type ink-jet printhead of the present invention produces the following effects.

First, since elements of a printhead including a substrate, in which a manifold, an ink chamber, and an ink channel are formed, a nozzle plate, and a heater are integrally formed into one body, the inconvenience of the prior art, in which a nozzle plate, an ink chamber, and an ink channel are separately manufactured and then are bonded to one another, and the problem of misalignment may be overcome. In addition, typical processes for manufacturing semiconductor devices may be directly applied to the manufacture of a bubble-jet type ink-jet printhead according to the present invention, and thus mass production of the printhead may be facilitated.

Second, since a groove for forming an ink channel is closed with a predetermined material layer, it is possible to prevent ink from leaking out through the groove.

Third, since a heater is formed in a ring shape and an ink chamber is formed as a hemisphere, it is possible to prevent backflow of ink and cross-talk among adjacent ink ejectors. In addition, since a bubble is formed in a doughnut-shape in the hemispherical ink chamber, it is possible to prevent the occurrence of satellite droplets. Moreover, according to an embodiment of the present invention, in which a bubble guide and a droplet guide are formed in an ink ejector, it is possible to precisely eject droplets in a direction perpendicular to a substrate.

While the present invention has been particularly shown and described with reference to preferred embodiments thereof, it will be understood by those of ordinary skill in the art that various changes in form and details may be made therein without departing from the spirit and scope of the invention as defined by the appended claims. For example, the elements of the printhead according to the present invention may be formed of different materials, which are not mentioned in the specification. A substrate may be formed of a material which is easy to process, instead of silicon, and a heater, an electrode, a silicon oxide layer, and a nitride layer may be formed from different materials. In addition, the methods for depositing materials and forming elements suggested above are just examples. Various deposition methods and etching methods may be employed within the scope of the present invention.

Also, the order of processing steps in the method for manufacturing a printhead according to the present invention may vary. For example, etching of the bottom portion of a substrate to form a manifold may be performed in the step shown in FIG. 8 or in a subsequent process.

Finally, numerical values presented in the specification may be freely adjusted within a range in which a printhead can operate normally.

What is claimed is:

1. A method for manufacturing an ink-jet printhead having a hemispherical ink chamber, comprising:

forming a nozzle plate on a surface of a substrate;

forming a heater having an interior diameter and an exterior diameter on the nozzle plate;

forming a manifold for supplying ink by etching the substrate;

forming an electrode on the nozzle plate to be electrically connected to the heater;

forming a nozzle, through which ink will be ejected, by etching the nozzle plate within the interior diameter of the heater to have a diameter smaller than the interior diameter of the heater;

forming a groove for forming an ink channel to expose the substrate by etching the nozzle plate so that the groove extends from the exterior diameter of the heater toward the manifold;

forming an ink chamber to have a diameter greater than the exterior diameter of the heater and to be substantially hemispherical by etching the substrate exposed by the nozzle;

forming an ink channel to provide flow communication between the ink chamber and the manifold by isotropically etching the substrate exposed by the groove; and closing the groove by forming a first material layer on the nozzle plate.

2. The method as claimed in claim 1, wherein the heater is formed in a ring-shape.

3. The method as claimed in claim 1, wherein the heater is formed in the shape of the Greek letter omega.

4. The method as claimed in claim 1, wherein the first material layer is a silicon nitride layer.

5. The method as claimed in claim 1, wherein the first material layer is a silicon oxide layer.

6. The method as claimed in claim 1, wherein the thickness of the first material layer is greater than half of the width of the groove.

7. The method as claimed in claim 1, wherein the first material layer is formed by chemical vapor deposition.

8. The method as claimed in claim 1, wherein the first material layer is formed only at the groove.

9. The method as claimed in claim 1, wherein the formation of the ink chamber and the formation of the ink channel are performed at the same time.

10. The method as claimed in claim 1, wherein the ink chamber is formed by isotropically etching the substrate exposed by the nozzle.

11. The method as claimed in claim 1, wherein the ink chamber is formed by anisotropically etching the substrate exposed by the nozzle and isotropically etching the substrate.

12. The method as claimed in claim 1, wherein forming the ink chamber comprises:

forming a hole to a predetermined depth by anisotropically etching the substrate exposed by the nozzle;

depositing a second material layer to a predetermined depth on the entire surface of the substrate which is anisotropically etched;

exposing a bottom portion of the hole and simultaneously forming a spacer of the second material layer at the sidewall of the hole by anistropically etching the second material layer; and isotropically etching the substrate exposed through the hole.

* * * * *